US006036062A

United States Patent [19]

von Fabris auf Mayerhofen

[11] Patent Number: 6,036,062

[45] Date of Patent: Mar. 14, 2000

[54] CLOTHES HANGER

[76] Inventor: Tilman von Fabris auf Mayerhofen, Swan - Der Kleiderbügel GmbH, Gilstr. 15, 81477 München, Germany

[21] Appl. No.: 08/912,865

[22] Filed: Aug. 19, 1997

Related U.S. Application Data

[63] Continuation-in-part of application No. PCT/DE96/00979, Jun. 4, 1996.

[51] Int. Cl.[7] ..... A47G 25/14

[52] U.S. Cl. ..... 223/85; 223/92

[58] Field of Search ..... 223/85, 92, 88, 223/95, 87

[56] References Cited

U.S. PATENT DOCUMENTS

| | | | |
|---|---|---|---|
| D. 200,942 | 4/1965 | Goldin | 223/92 |
| 1,324,679 | 12/1919 | McClure | 223/92 |
| 2,412,735 | 12/1946 | Isaak | 223/88 |
| 3,485,423 | 12/1969 | Wagar et al. | 223/85 |
| 5,613,628 | 3/1997 | Burkhalter | 223/85 |
| 5,645,200 | 7/1997 | McDowell et al. | 223/85 |
| 5,806,727 | 9/1998 | Joseph | 223/92 |

*Primary Examiner*—Bibhu Mohanty

*Attorney, Agent, or Firm*—Dennison, Meserole, Scheiner & Schultz

[57] ABSTRACT

A one-piece clothes hanger (1), with a hanger suspension region (3) and at least two hanger arms (6, 11, 15), of which the first hanger arm (6) leading from the hanger suspension region (3) has a first and a second arm section (6*a,* 6*b*), which are spaced apart from each other by means of an intermediary region (7) that is open on one end, wherein the top sides (6', 11') of the first and second hanger arms (6, 11) enclose an obtuse angle, in particular of less than 180°, with the vertex toward the suspension region (3), and wherein the intermediary region (7) is embodied as a narrow gap (7) or incision (7) between the first and second arm sections (6*a,* 6*b*).

12 Claims, 8 Drawing Sheets

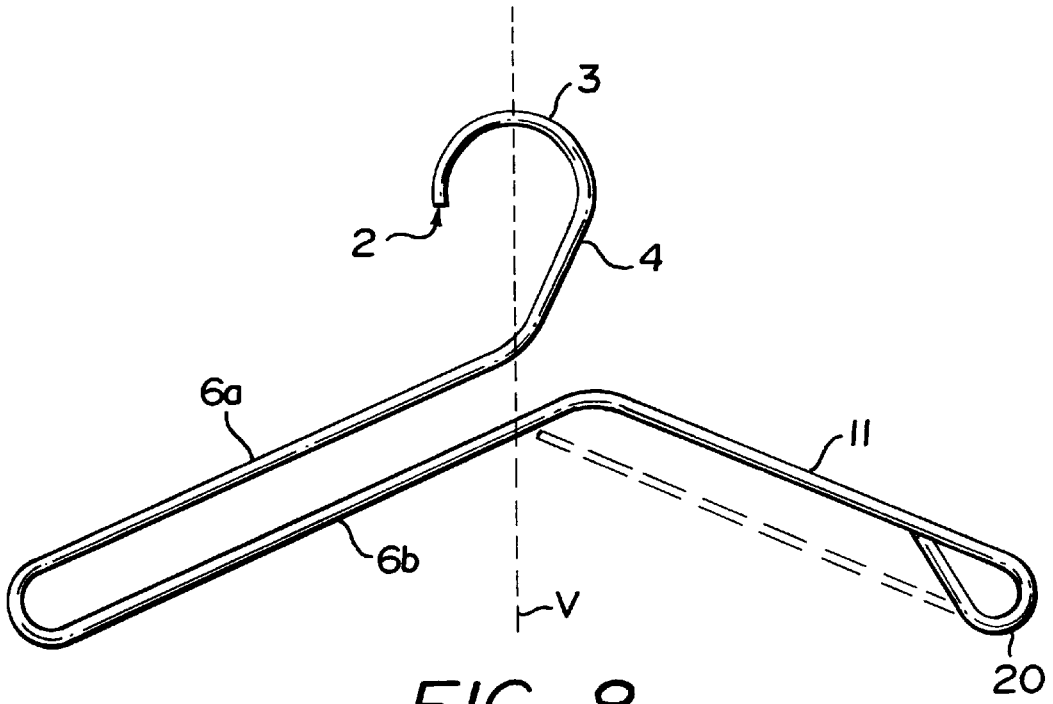
FIG. 8
FIG. 9A
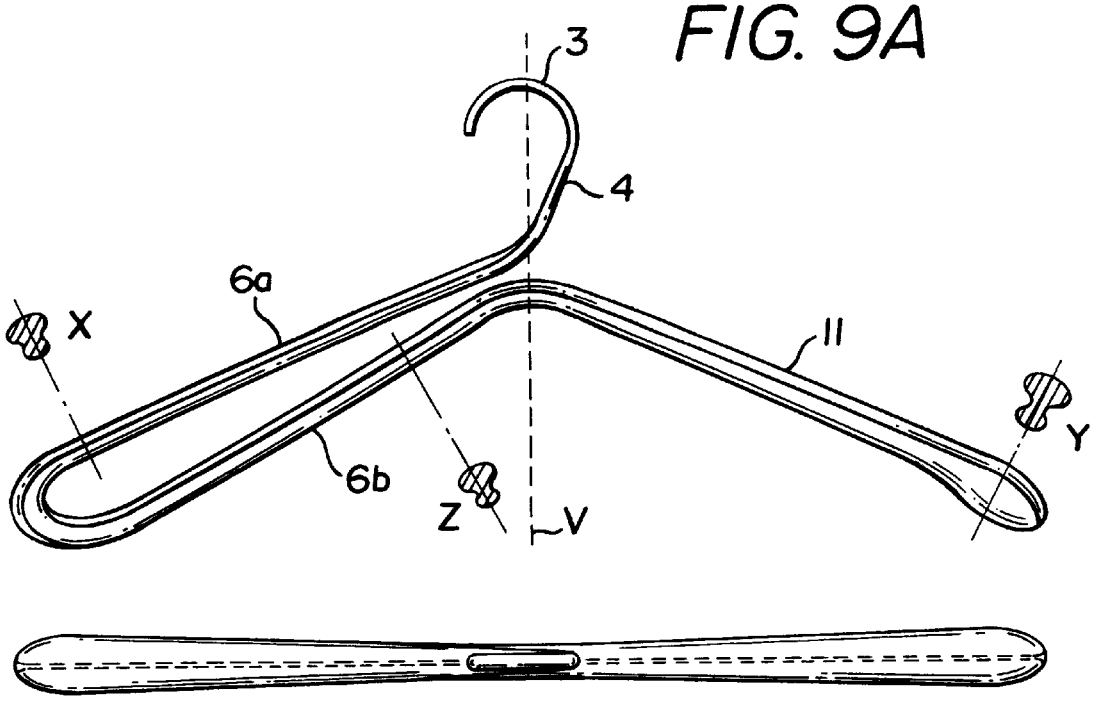
FIG. 9B

CLOTHES HANGER

This is a continuation-in-part of PCT application Ser. No. PCT/DE96/00979 filed Jun. 4, 1996.

BACKGROUND OF THE INVENTION

Clothes hangers are known that have two hanger arms and a hanger hook for suspending the hanger e.g. on a wardrobe rod wherein, as a rule, the hanger hook is disposed in a weight-centered fashion above the hanger arms and the hanger arms originate from a branch on the lower end of the hanger hook and extend outward from this point. In order to achieve weight symmetry, the entire hanger down to details in the hook region is essentially symmetrical with regard to the vertical axis, which passes through the connecting region between the hanger hook and the hanger arms.

In addition to holding jackets, coats, and the like, this kind of clothes hanger is also used for holding shirts, blouses, dresses, sweaters, and other high-necked and/or buttoned items of clothing.

On the other hand, there are also known clothes hangers which are embodied as of one piece, i.e. unbranched. As a rule, the hanger starts from a hook region, which is embodied in a weight-centered fashion, first extends laterally outward in order to embody one hanger arm and then in a more or less wide arc, extends out horizontally beyond the vertical center line of the hanger in a horizontal direction toward the side disposed laterally opposite so that the second hanger arm is embodied essentially as horizontal. Hangers of this kind are as a rule used to hold items of clothing which can be stored in the simplest manner by virtue of the fact that they are placed, for example, over a horizontally disposed holding rod. This pertains in particular to shawls, scarves, but also to pants, wherein the latter are folded approximately in the center between the knee region and the crotch, perpendicular to the pressed crease, placed over the horizontally disposed hanger rod of a hanger of this kind, and after the hanger is suspended, freely hang down vertically from the horizontal hanger rod.

With the use of this kind of hangers for holding shirts, blouses, dresses, sweaters, or other high-necked and/or buttoned items of clothing, the following problem occurs: if the subject at hand is high-necked items of clothing that can be buttoned in a collar or neck region, such as shirts, blouses, or dresses, then before the item of clothing is held, it must be opened in the collar or neck region in order to permit the insertion of the hanger arms through the then-widened neck opening of the clothing item and into the arm openings. The hanger, with the securely held item of clothing can be placed, e.g. on a wardrobe rod, wherein it may, however, be necessary to close the collar or neck region once more in order to fix the item of clothing on the hanger. After the retrieval of the hanger from the wardrobe rod, it is necessary to reopen the collar or neck region of the clothing item in order to remove the piece of clothing.

The repeated opening and closing of the collar or neck region is as a rule tedious and time-consuming and particularly with freshly washed, starched, and ironed shirts, brings with it the danger of creasing and soiling the collar or neck region.

The other conceivable possibility for handling conventional clothes hangers, namely their insertion through the bottom opening at the waist region of the clothing item, is involved and therefore not practicable in volume operation, and additionally increases the danger of creasing or soiling.

When holding sweaters, particularly narrow and high-necked roll-collared sweaters, in order to insert the hanger arms into the arm openings, a stretching of the neck or collar region is required, by means of which over the long term, the neck or collar region of the sweater becomes overstretched and worn out, wherein the item of clothing finally loses its shape and wears out.

SUMMARY OF THE INVENTION

The invention relates to a one-piece clothes hanger with a hanger suspension region and at least two hanger arms for holding pieces of clothing, of which the first hanger arm, which starts from the hanger suspension region, has a first and a second arm section, which are spaced apart by means of an intermediate region that is open on one end.

The object of the invention is to produce a clothes hanger of the type mentioned above, which in particular permits high-necked items of clothing, e.g. already buttoned blouses, shirts, or dresses to be hung and unhung in as simple a manner as possible and permits a particularly gentle storage of this kind of clothing items.

With a clothes hanger according to the invention, the intermediary region between the first and the second arm sections of the first hanger arm adjoining the hanger suspension region is embodied as an slot or as a narrow gap. As a result, it is possible to hang a high-necked item of clothing on the hanger, particularly a shirt that has already been buttoned in the collar region, i.e. in particular, to insert the hanger arm through the neck opening into the arm openings without having to widen the neck or collar region of the clothing item by opening it. To that end, the clothes hanger according to the invention is grasped with one hand e.g. in the hanger suspension region and moved in such a way that the second hanger arm that adjoins the first hanger arm passes through the neck or collar opening of the clothing item and from the inside, is inserted into an arm opening. Then, the hanger is moved further in the same direction in such a way that the neck or collar region of the clothing item slides into the intermediary region between the first and the second arm sections of the first hanger arm, and then, by means of a pivot of the hanger, the first hanger arm is slid completely through the neck or collar opening of the clothing item. By means of a sliding of the hanger in the opposite direction, the first hanger arm then slides from the inside into the other arm opening of the clothing item in such a way that the item of clothing then comes to rest evenly on both hanger arms.

The upper side of the first and second hanger arms form an obtuse angle in relation to each other, which is in particular smaller than 180° and whose vertex points toward the hanger suspension region. This has the advantage that the items of clothing held come gently to rest on the hanger arms, which have a downward-angled form adapted to the shoulder region of the clothing item. The design of the clothes hanger according to the invention consequently permits a simple and rapid hanging and unhanging, particularly of high-necked items of clothing, and permits them to be gently stored.

So that the insertion of the neck or collar region of the clothing item to be hung can be carried out in as simple a manner as possible without pivoting the hanger around a horizontal axis, it is suitable to choose the arm sections and the intermediary region between the arm sections in such a way that at least in the region of the opening of the intermediary region, the first arm section is disposed above the second arm section and originates from the suspension region, wherein the two arm sections are connected to each other in an outer end region.

In one embodiment of the invention, the arm sections can be disposed horizontally next to each other in the end region of the first hanger arm, and the arm sections can be disposed vertically above each other in the region where the first arm section originates from the suspension region. The transition of the vertical disposition of the arm sections in the vicinity of the hanger suspension region to the horizontal disposition of the arm sections in the end region is carried out, for example, in a monotonic fashion. It is favorable if the distance between the first and the second arm section is essentially constant. Depending on the use, it can also be advantageous to disposed the arm sections at the same height next to each other or to dispose the second arm section above the first arm section.

By means of these measures, an inadvertent slipping of a clothing item can be prevented, particularly during the volume operation, e.g. of a large-scale cleaning establishment.

Another simplification of the handling is achieved when the second hanger arm originates from the second arm section of the first hanger arm at the vertex of the angle between the two arms. The two hanger arms are separated from each other precisely at that point by means of the angle region, and the threading of the respective hanger arms into the arm openings then becomes particularly free of complications.

To attach the clothes hanger, in a particularly simple embodiment, the suspension region can be embodied as a hook element, which is disposed in a particularly weight-centered fashion between the first and second hanger arms. This allows the clothes hanger to hang balanced even when empty or with a light item of clothing, wherein the hanger arms are disposed essentially at the same height.

Depending on the use, it is favorable to orient the opening of the hook in the same or opposite direction in relation to the opening of the intermediary region. It is also possible for there to be a hook that can rotate around a vertical axis.

In order to enable the one-handed threading of the hanger arms into the arm openings in as simple a manner as possible, it is advantageous that the hook element starts from a point and leads into a linearly embodied neck region, wherein the neck region then transitions into the first arm section of the first hanger arm. The neck region can serve as a handle during the one-handed threading of the hanger arms and the hook element, and, facilitates the coordination when pivoting the hanger during the insertion into a neck region of a clothing item.

The suspension region of the clothes hanger according to the invention, however, can also have adhesion mechanisms, e.g. in the form of a suction cup for fixing to a smooth surface or a hooked strip for attaching to a surface covered with textile. Furthermore, it is also conceivable to have fixing elements with snap fasteners and roll elements, as are common in clothes hanger carrousels in laundry establishments.

It can also be advantageous to dispose the suspension region asymmetrically and not in a weight-centered fashion between the hanger arms. This is suitable particularly with unusual items of clothing with an asymmetrical cut, since only then is it possible to store this kind of items of clothing so that they hang in a balanced manner.

In order to be able to hang a different item of clothing in addition to a shirt, a blouse, or the like, it may be necessary and suitable to provide a third hanger arm. This preferably adjoins in the outer end region of the second hanger arm, wherein the angle to the second hanger arm and the length of the third hanger arm are chosen in such a way that the third hanger arm is essentially aligned horizontally, points in the direction of the end region of the first hanger arm, and produces only a slight space, e.g. in the form of a gap, between the end regions of the third and the first hanger arm. In this way, in addition to shirts and blouses, which are hung by means of the first and the second hanger arms, items of clothing that are usually simply hung over a horizontally disposed rod such as pants, scarves, or ties, can also be held on the same hanger. The slight spacing of the end regions of the first and third hanger arms permits a simple threading of the clothing item to be hung on the third hanger arm.

It is also conceivable not to have the third hanger arm originate at the end region of the second hanger arm or to embody the third hanger arm so that it can pivot in relation to the second hanger arm.

In addition to the increased simplicity of hanging buttoned items of clothing, the threading of the hanger arms into the arm openings of the clothing items should also occur in a particularly gentle manner. To this end, it is particularly suitable to embody the hanger arm end regions as rounded.

In one embodiment of the invention, the second hanger arm has an outer end region which is slightly bowed downward and by means of a parallel return, is embodied like a loop. This loop can be embodied in the shape of a circular arc, a parabola, or an ellipse. If the intermediary region of the first hanger arm and the loop-shaped end region of the second hanger arm, which is embodied with the return, are embodied as essentially symmetrical to each other in relation to a horizontal intersecting plane, then the end regions of the hanger arms are shaped so they are wider than the centrally embodied suspension region so that a relatively wider threading and support region for the item of clothing is produced, which leads directly to a particularly gentle storage of the clothing item on the hanger, particularly in the shoulder region of the clothing item.

In one embodiment of the invention, the cross sections of the arm sections, the hanger arms, or the suspension region are embodied as approximately circular for a gentle handling of the hanger in connection with the item of clothing to be stored. A hanger of this kind can be produced in a simple manner by bending a suitable wire or tube. In addition to circular cross sections for the wire and tube, arbitrarily rounded cross sectional forms are naturally also conceivable, such as parabolic or elliptical cross sections, for example.

A particularly reasonably priced and material-saving embodiment for a clothes hanger according to the invention is produced as a hollow form, e.g. as a bent metal tube, as molded plastic, or as a correspondingly formed sheet metal profile.

In particular with plastic hangers, a milled T-shape or double T-shape is particularly effective with regard to a material savings. Then the hanger has an increased rigidity and, particularly in the end regions of the hanger arms, the T-shape or the double T-shape can be used as a particularly wide support area that is therefore gentle to the clothing. It is also suitable to form the edges of the T-shape or the double T-shape as rounded.

In order to prevent the high-necked item of clothing that is hung on the hanger from slipping off, according to one embodiment of the invention, the gap region between the first and second arm section of the first hanger arm can be closed. The elastic properties of the hanger can be utilized in order to move the first arm section in relation to the second arm section in such a way that the bend between the neck of the suspension region and the second arm section is guided downward past the angle region between the first and second hanger arm and when guided back upward, catches on a hook element embodied there. This closes the gap region between the first and second arm section.

The hook element can for example be embodied as a type of collar in the region of the angle between the first and second hanger arm, in which region the second arm section of the first hanger arm as well as the second hanger arm are admitted, wherein the hooking of the first arm section occurs through engagement with a projection on the collar and wherein use is made of the initial stress of the first arm section in relation to the second arm section, and this initial stress is produced by the elasticity of the hanger. One type of hook element can also be embodied directly on the second arm section of the first hanger arm in such a way that a type of projection is incorporated into this hanger arm and can be engaged by the first arm section in the same manner as in the instance of the collar.

In a further embodiment of the invention, the arm sections of the first hanger arm and the intermediary region are embodied as essentially equal in thickness and approximately parallel in such a way that a parabolic or elliptical shape is produced for the outer and/or inner contour for the course starting from the first arm section, over the end region, and to the second arm section. A rounded and/or elongated, approximately elliptical cross sectional embodiment is favorable for especially gentle storage, which in particular prevents wear in the shoulder region of clothing items.

Wood, metal, plastic, plexiglas, or acrylic glass can be used as materials for producing the hanger, wherein combinations of these materials in a hanger can also be suitable, e.g. for producing a particularly hardy base frame or suspension region.

A reasonably priced and material-saving embodiment for a clothes hanger according to the invention is produced as a hollow form, e.g. molded out of plastic or as a correspondingly formed sheet metal profile.

In particular, a hanger that is embodied of one piece is suitable for mass production of the clothes hanger according to the invention.

In order to produce the weight symmetry of the clothes hanger, the material thicknesses and cross sectional profiles of the individual hanger arms and the arm sections can be varied. In particular, for the purpose of weight balancing in relation to the two-section first hanger arm, the second hanger arm can have a higher material thickness than the individual arm sections of the first hanger arm.

Furthermore, the hanger according to the invention can have cross sectional recesses which in particular serve to establish the weight symmetry of the hanger and which are in particular embodied in the form of circular openings. The outer end regions of the first and the second hanger arms are particularly suited for this because the balancing out of the equilibrium is particularly effective there. For this purpose, the recesses thus embodied can also contain corresponding materials as weights.

Moreover, notches can be provided on the top sides of the first and second hanger arm, in a particularly preferable manner in the vicinity of the end regions of the hanger arms. In addition to producing the weight symmetry of the hanger, these notches have the additional advantage that they can hold the loops of skirts, dresses, pants, or the like so that the clothes hanger according to the invention can be universally used because skirts, dresses, pants, and the like can also be hung on it.

In another embodiment of the invention, the top sides of the first and second hanger arms and/or the top side of a possibly provided horizontally extending third hanger arm have a wavy course. This produces the possibility of the hanger holding items of clothing provided with loops, wherein depending on their spacing from each other, the loops engage in corresponding recesses in the wavy course.

Since with a greater spacing of the loops, they engage in recesses in the outer region of the hanger arms and in this region, the danger of the loop slipping is greater, the recesses in the outer region are preferably embodied as deeper.

Particularly with items of clothing that have very flexible shoulder regions, the wavy course also produces a higher friction and therefore an improved securing of the clothing item. The waves coming to an end gently in the direction of the vertical axis of the hanger provide that the threading process is not hindered due to the increased friction.

The invention will be explained in more detail below from the exemplary embodiments in conjunction with the schematic drawings.

FIG. 1 is a front view of a clothes hanger according to the invention, in accordance with a first exemplary embodiment;

FIGS. 2*a* and 2*b* are front views of two versions of a clothes hanger according to the invention, in accordance with a second exemplary embodiment;

Figure 10:
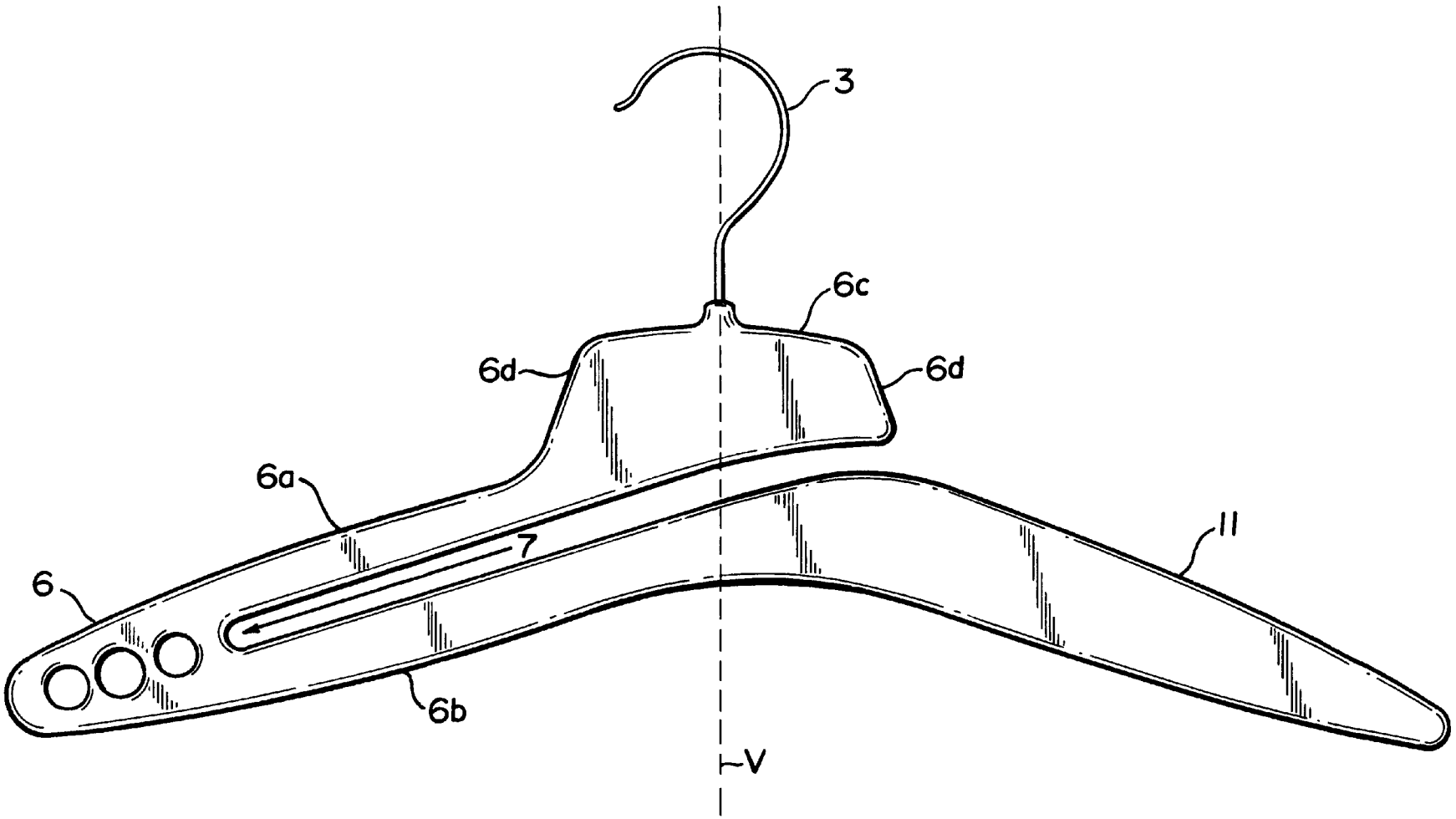

FIGS. 5, A and B, are front views of a clothes hanger according to the invention, in accordance with another exemplary embodiment, wherein the hanger is depicted in the open state (A) and in the closed state (B);

FIG. 6 is a view of a hook element according to the invention for opening and closing the clothes hanger according to the invention in FIG. 5, wherein the hook element is represented in a front view (A) and in section (B);

FIG. 7 shows views of a clothes hanger according to the invention, in accordance with another exemplary embodiment, in a front view (A), a bottom view (B), and a sectional view (C) at a location where another hook element is embodied to open and close the hanger;

FIG. 8 is a front view of a clothes hanger according to the invention, in accordance with another exemplary embodiment;

FIG. 9 shows front (a) and top (b) views of a clothes hanger according to the invention, according to another exemplary embodiment, and FIG. 10 is a front view of another embodiment of a clothes hanger according to the invention.

DESCRIPTION OF PREFERRED EMBODIMENTS

Figure 1:
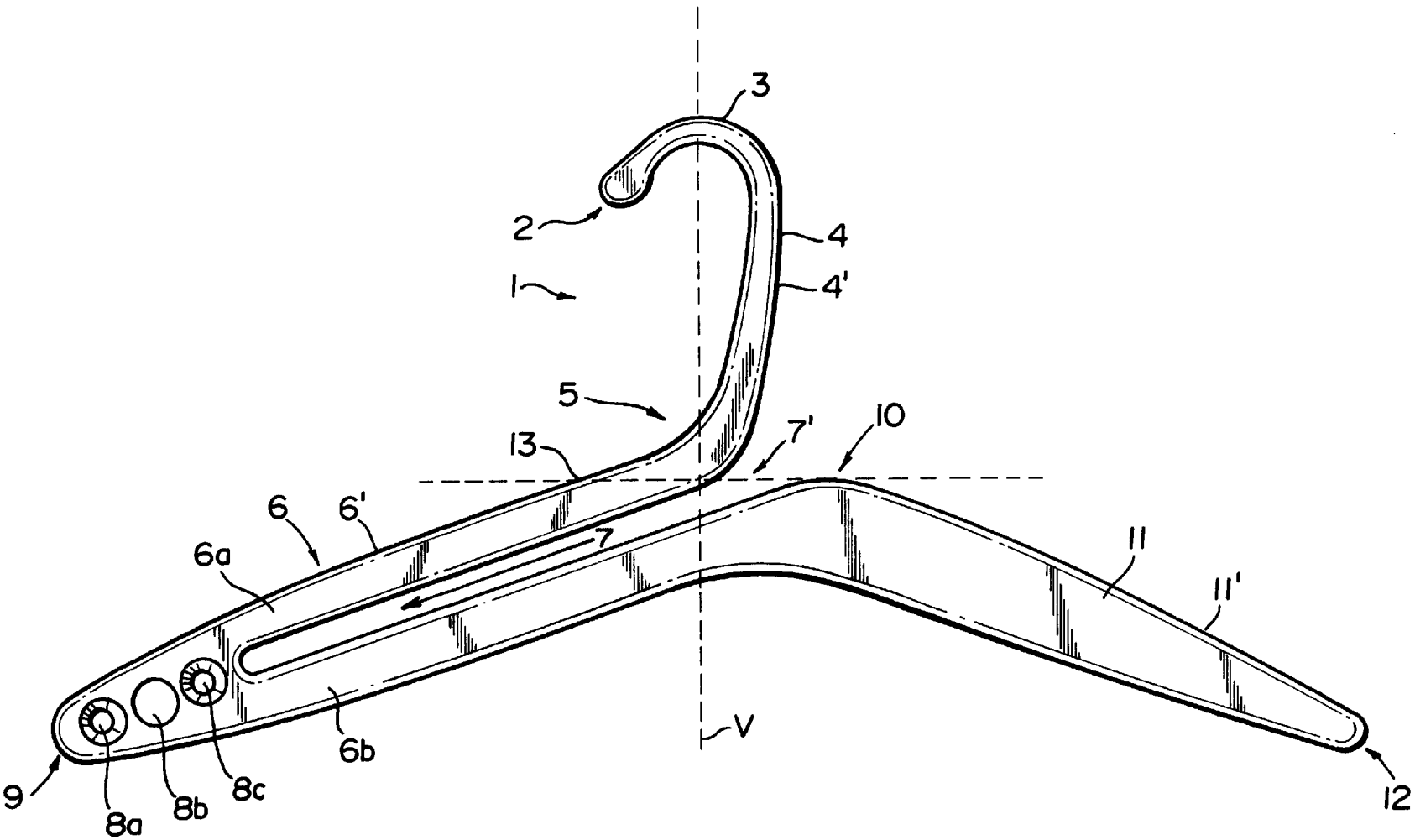

The exemplary embodiment of a clothes hanger according to the invention shown in FIG. 1 has a hanger suspension region 3 embodied as a hook and has two hanger arms 6 and 11. The first hanger arm 6 connected to the hook 3 extends to the left and is comprised of two arm sections 6*a* and 6*b*, which are connected to each other in the outer end region 9 on the left.

The opening of the hook 3 is disposed opposite the opening of the intermediary region 7 that divides the arm sections 6*a* and 6*b* from each other. The hook 3 has a rounded and slightly widened end region 2 and is essentially embodied as semicircular, wherein the transition from the hook 3 to the first arm section 6*a* is produced by means of an essentially linear neck region 4 that extends downward and slightly to the left. The arm sections 6*a* and 6*b* are disposed one above the other, wherein the first arm section 6*a* disposed on top originates from the neck region 4 at a bend 5.

The arm sections 6*a* and 6*b* of the first hanger arm 6 and the intermediary region 7 between the arm sections 6*a* and 6*b* are embodied as approximately equal in thickness and extend approximately parallel to each other. In the hanger according to FIG. 1, there is a nearly parabolic or elliptical outer or inner contour of the first hanger arm 6 with regard to the end region 9 of the first hanger arm 6.

The second hanger arm 11 adjoins the second, lower arm section 6*b,* wherein the course of the top side 6' of the first hanger arm 6, together with the course of the top side 11' of the second hanger arm 11, encloses an angle of approximately 150°. In the bend region 10, the top side 11' of the second hanger arm transitions into the course of the top side 6*b*' of the lower arm section 6*b*.

The bend region is chosen so that it comes to rest relatively close to the vertical V, which is disposed in the center between the end regions 9, 12 of the first and second hanger arms. The same is also true for the bend 5 at which the upper arm section 6*a* of the first hanger arm 6 originates from the neck region 4. This can assure that even with items of clothing with narrow or small neck openings, the shoulder regions of the clothing item that adjoin the neck opening rest on the top sides 6' and 11' of the first and second hanger arms. The shape of the clothing item is consequently supported in these regions as well so that even with a long time on the hanger, the clothing item is prevented from stretching.

As shown in FIG. 1, the hanger 1 has a form that is axially symmetrical to the vertical V with regard to the course of the top sides 6', 11' in the regions between the bend region 10 and the end region 12 on the one hand and between the intersecting point 13 of the horizontal tangent at the bend region 10 with the top side 6' and the end region 9 on the other hand. This produces a symmetrical support of the shoulder regions of (outer) clothing items that are as a rule symmetrical.

The approach of the point 13 and the bend region 10 as close to each other as possible can be achieved by virtue of the fact that the light weight of the approximately straight intermediary region 7 (at least in the region of the opening) is chosen to be just large enough that an easy threading of the clothing item is assured and nevertheless, the axially symmetrical course of the top side 11' can come close to the vertical V.

The threading of the clothing item into the intermediary region 7 is facilitated by virtue of the fact that the opening 7' of the intermediary region is respectively comprised by means of the convex curvatures of the bend region 10 and the extension of the underside of the hanger arm 6*a* in the region of the bend 5.

Since the region of the outside 4' of the neck region 4 adjoining the opening 7', together with the underside of the hanger arm 6*a,* encloses an angle that is greater than 180° and less than 270°, this assures a simple and guided reception of the clothing item into the intermediary region 7.

The end region 9 of the first hanger arm 6 has circular recesses 8*a,* 8*b,* and 8*c* for achieving the weight symmetry of the hanger. The end region 12 of the second hanger arm 11 is rounded.

Furthermore, the thickness of the second hanger arm 11 is chosen, for example, so that it corresponds approximately to the sum of the thicknesses of the hanger arms 6*a* and 6*b*. This already produces an approximately balanced hanger from the start, with an approximately constant thickness of the hanger and a suspension region or hook 3 that is disposed approximately in the center. Serious measures for balancing the hanger by providing recesses or affixing weights are therefore no longer necessary. A balancing can be produced almost exclusively by means of a suitable course of the hook 3.

Figure 2A:
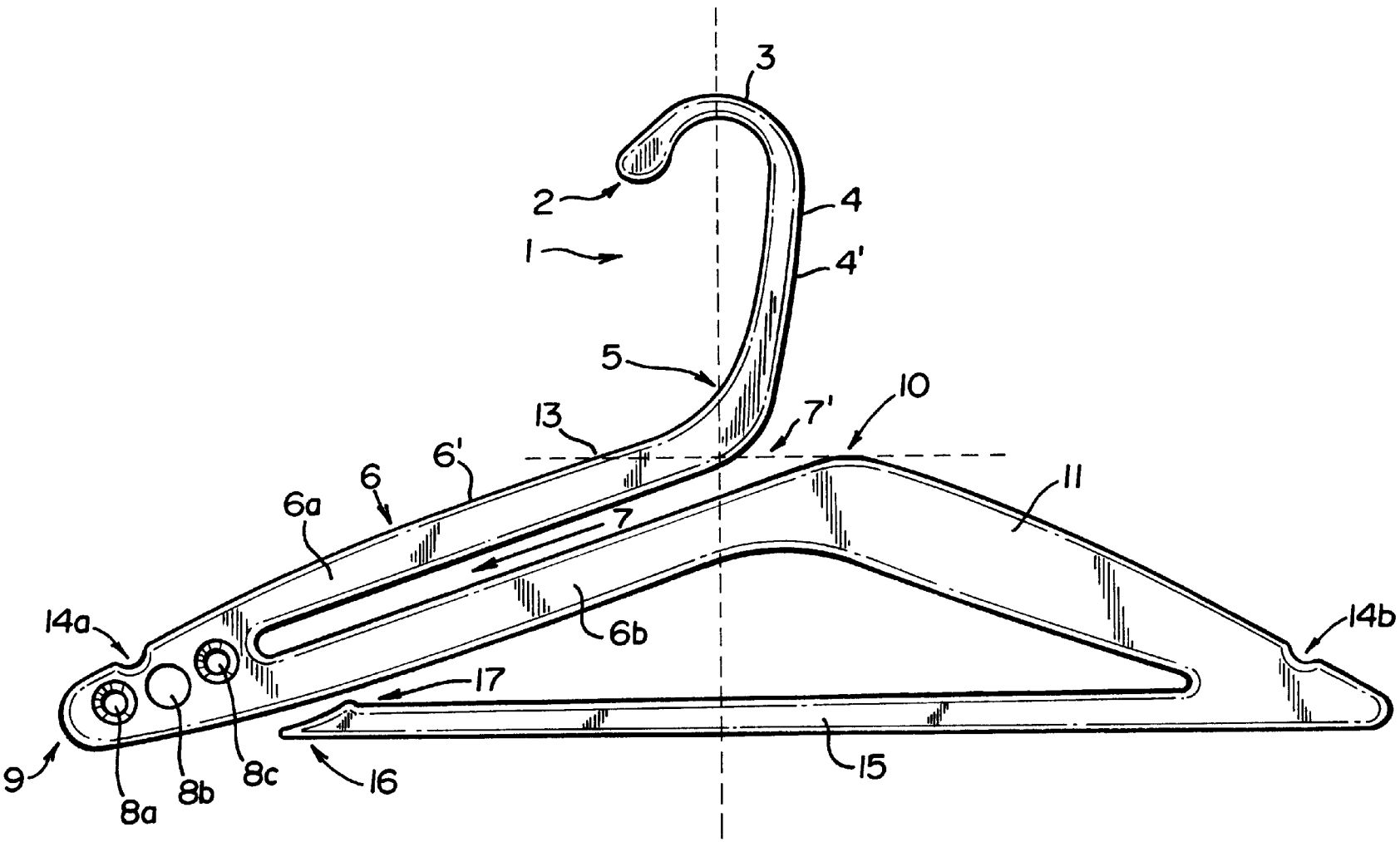

FIG. 2*a* shows a second embodiment of a clothes hanger 1 according to the invention, wherein in relation to the exemplary embodiment shown in FIG. 1, on the one hand, notches 14*a* and 14*b* are embodied on the top sides in the vicinity of the end region 9 of the first hanger arm 6 and the end region 12 of the second hanger arm 11, and on the other hand, a third hanger arm 15 that adjoins the second hanger arm 11 is additionally embodied.

The third hanger arm 15 adjoins the end region 12 of the second hanger arm 11 in such a way that it is guided essentially in a horizontal direction back toward the end region 9 of the first hanger arm 6 and in the vicinity of the end region 9 of the first hanger arm 6, a narrow gap is formed between the end region 16 of the third hanger arm 15 and the underside of the end region 9. As a result, the course of the first, second, and third hanger arms as a whole, assumes the form of a shallow isosceles triangle.

The third hanger arm 15 is embodied toward its end region 16 as tapered in regard to its cross section, wherein directly in the end region 16, an edge 17 is formed by a slight material widening and is intended to prevent items of clothing from slipping through the gap between the third hanger arm and the first one.

Figure 2B:
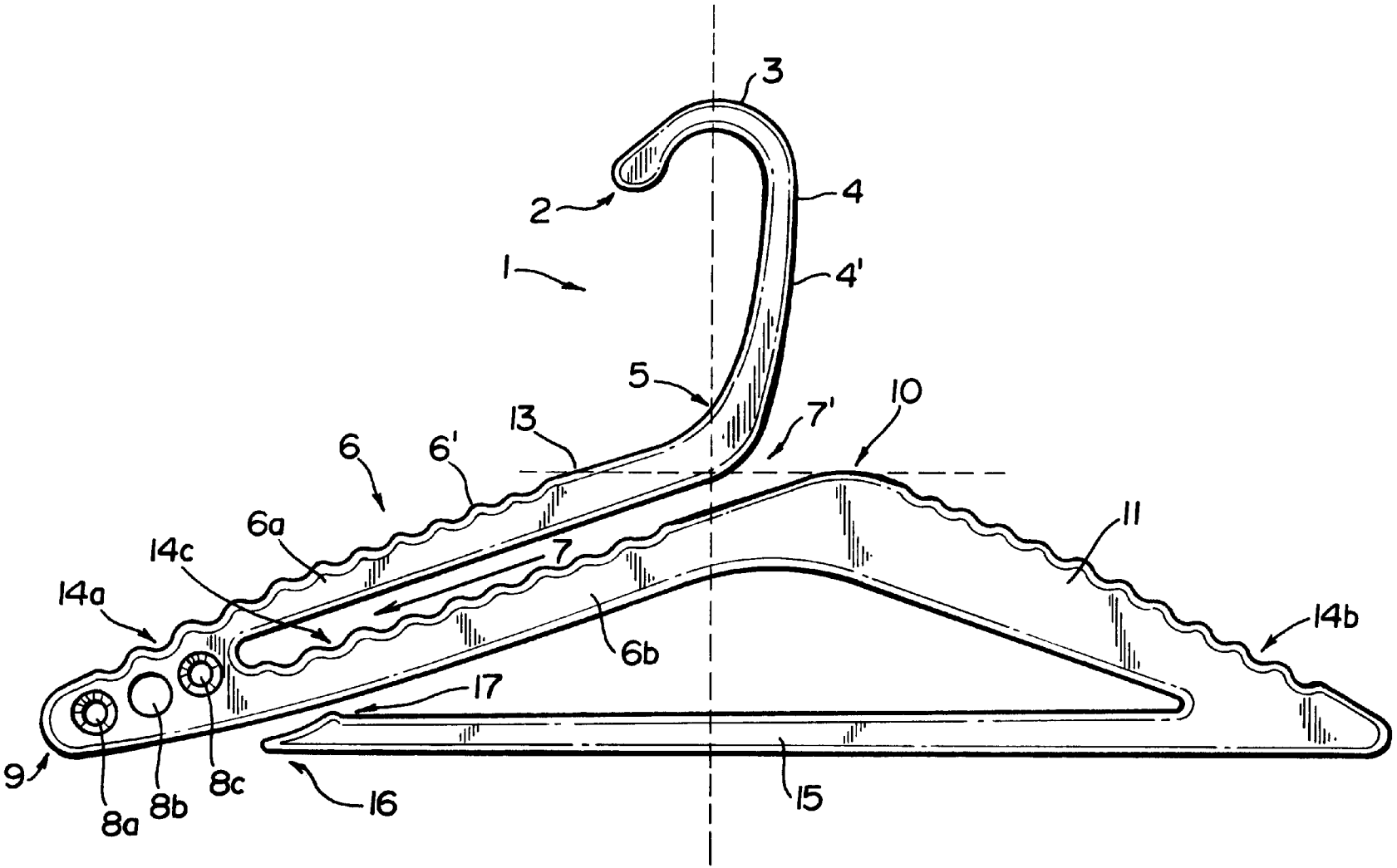

The second version of this second exemplary embodiment shown in FIG. 2*b* differs from the version according to FIG. 2*a* by means of the wavy course of the top sides of the first and second arm sections 6*a,* 6*b* of the first hanger arm 6 as well as the second hanger arm 11. This affords the possibility of securing clothing items by means of corresponding loops that engage in the recesses 14*a,* 14*b,* 14*c* of the wavy courses, depending on the spacing of these loops. A progression that gradually peters out, wherein the depths of the recesses continuously reduce, produces the advantage that the threading process is not disadvantageously hindered by the wavy course.

Incidentally, the above embodiments for the versions of this second exemplary embodiment also correspondingly apply to the first exemplary embodiment.

Figure 3:
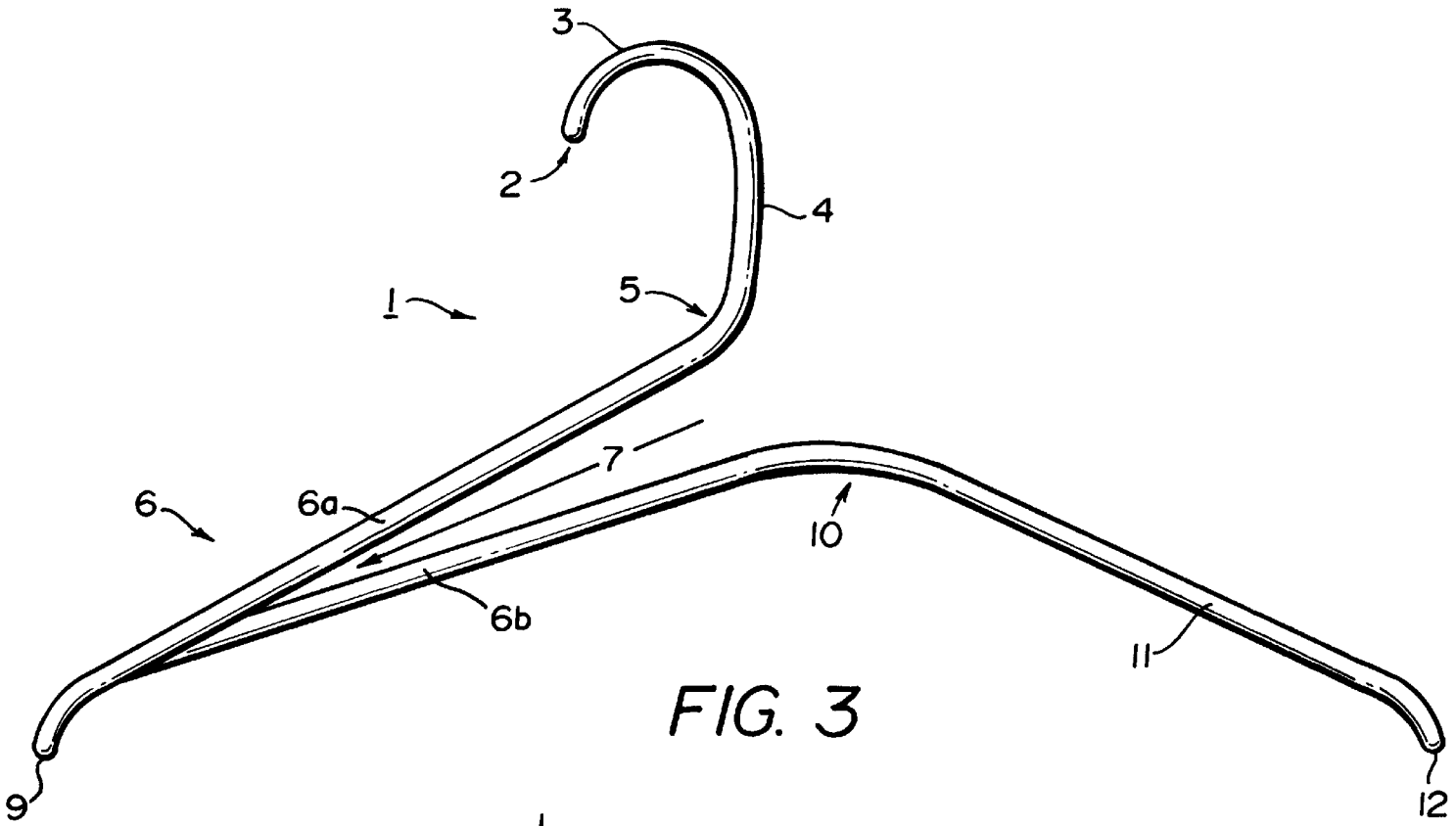
FIG. 3 is a front view of a clothes hanger according to the invention, in accordance with a third exemplary embodiment.

The exemplary embodiment shown in FIG. 3 likewise has a hanger suspension region 3 embodied as a hook, and two hanger arms 6 and 11, wherein the first hanger arm 6 that adjoins the hook 3 extends toward the left and is comprised of two arm sections 6*a* and 6*b* which are connected to each other in the outer end region 9 on the left.

The opening of the hook 3 is disposed opposite the opening of the intermediary region 7 that divides the arm sections 6*a* and 6*b* from each other. The hook 3 has a rounded end region 2 and is essentially embodied as semicircular, wherein the transition from the hook 3 to the first arm section 6*a* by means of an essentially linear neck region 4 that extends downward and slightly to the left. The arm sections 6*a* and 6*b* are disposed essentially one above the other, wherein the first arm section 6*a* disposed on top originates from the neck region 4 at a bend 5 and at that point, is disposed vertically directly above the second arm section 6*b*.

Figure 4:
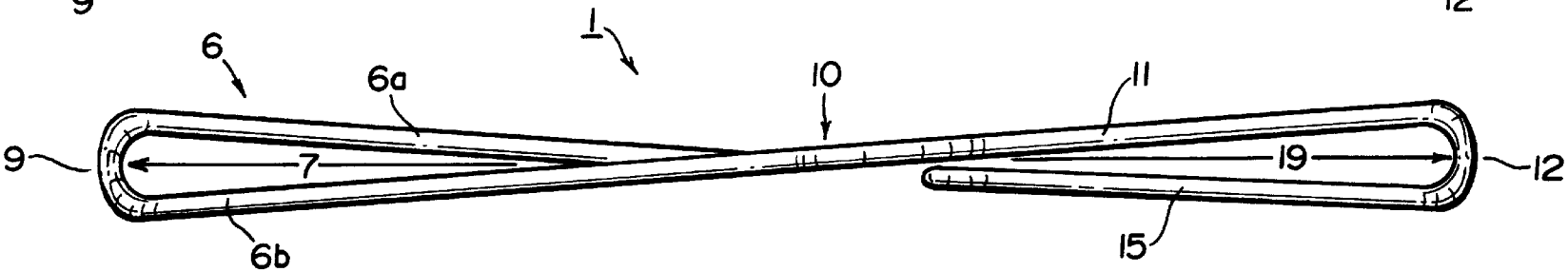
FIG. 4 is a view from above of the clothes hanger according to the invention in FIG. 3.

The arm sections 6*a* and 6*b* of the first hanger arm 6 and the intermediary region 7 between the arm sections 6*a* and 6*b* are embodied as approximately equal in thickness and extend in monotonic fashion around each other so that with regard to the end region 9 of the first hanger arm 6, on the one hand, a loop-shaped outer or inner contour is formed, as shown in FIG. 4, which is bowed slightly downward, and on the other hand, the arm sections 6*a,* 6*b* in the end region 9 are disposed next to each other horizontally on one level.

The second hanger arm 11 adjoins the second, lower arm section 6*b,* wherein the first hanger arm 6, with its two arm sections 6*a* and 6*b,* encloses an angle of approximately 150°.

The end region 12 of the second hanger arm 11 is symmetrically constructed in relation to the end region 9 of the first hanger arm 6. This results essentially by virtue of the fact that in the outer end region 12, the second hanger arm 11 has a part 15 embodied as a loop 19 that is guided back in a parallel fashion. Like the end region 9 of the first hanger arm, this loop 19 is bowed slightly downward.

FIG. 4 shows a view from above onto the same exemplary embodiment for a clothes hanger according to the invention as shown in FIG. 3. Here, it can be plainly seen that the end regions 9 and 12 of the hanger arms 6 and 11 are symmetrically constructed by means of intermediary regions 7 and 19 embodied essentially in the shape of loops. The central bending region 10 at which the hanger suspension region is also disposed is essentially narrower than the end regions 9 and 12. The outermost tip of the parallel return 15 of the second hanger arm 11 is slightly rounded.

FIGS. 5 to 7 represent how the clothes hanger 1 according to the invention can be closed with regard to its intermediary region 7 between the first arm section 6*a* and the second arm section 6*b* in order to prevent the clothing items from slipping out once they have been hung.

FIG. 5 shows a clothes hanger 1 according to the invention that has a hook element for opening and closing the hanger in the form of a collar 17 in its angle region 10 between the first hanger arm 6 and the second hanger arm 11, 15.

Figure 5A:
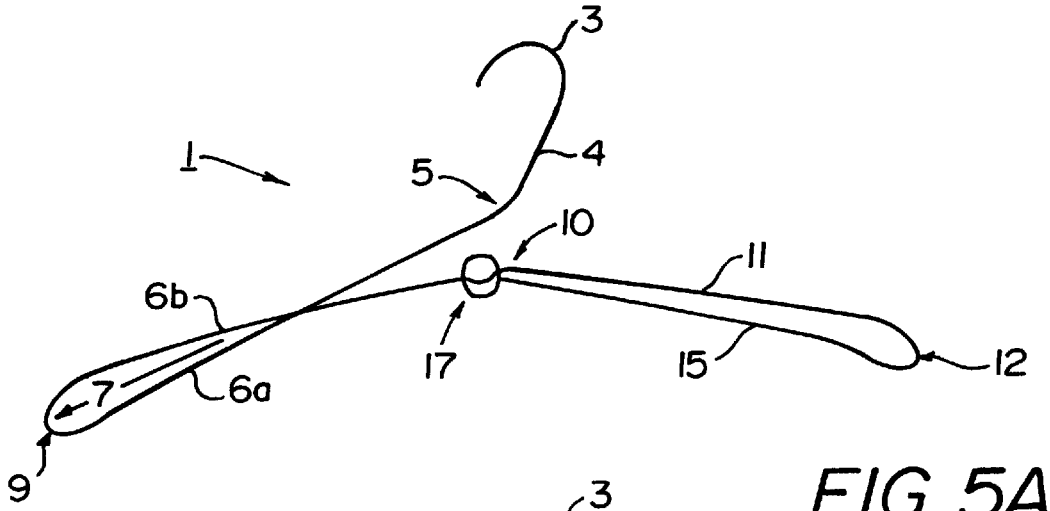
Figure 5B:
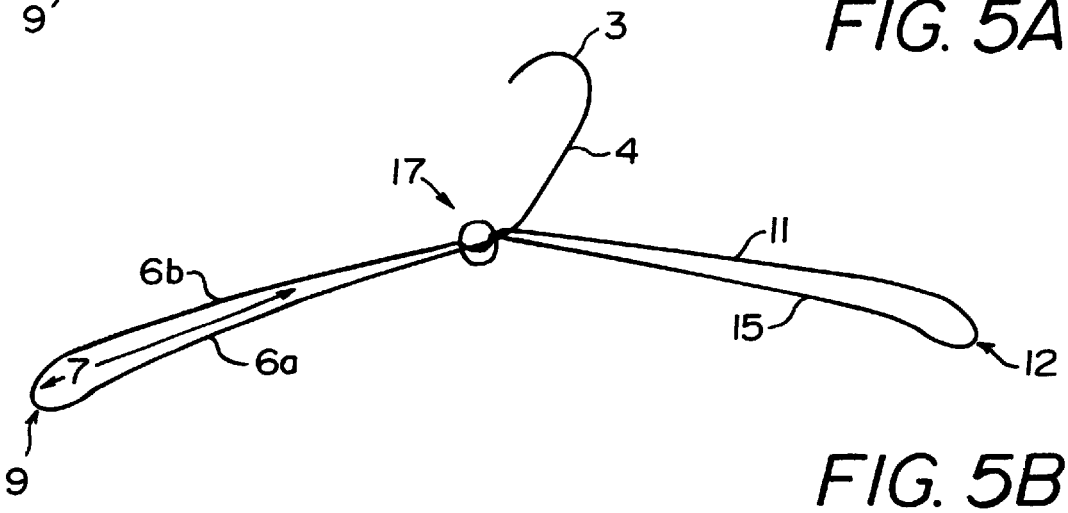

FIG. 5A shows the clothes hanger 1 in the open state in which the high-necked item of clothing can be hung by means of threading as described above. After the threading, the first arm section 6*a* of the first hanger arm 6 can be moved downward in relation to the second arm section 6*b* in such a way that the bend 5 between the neck region 4 of the suspension region 3 and the first arm section 6*a* is guided past the bending region 10 between the first hanger arm 6 and the second hanger arm 11, 15. After the release of the first arm section 6*a,* this tries to snap back into its initial position driven by the elastic forces, wherein it comes into engagement, however, with the projection 18 of the hook element 17 and is held there so that the hanger is now in a state in which the intermediary region 7 is closed, as shown in FIG. 5B.

Figure 6B:
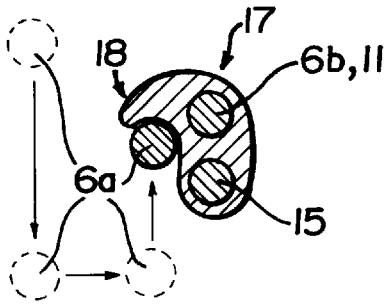
Figure 6A:
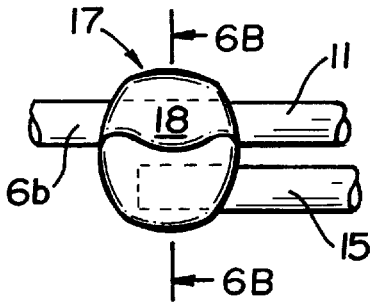

FIG. 6A shows an enlarged depiction of the hook element 17 for opening and closing the intermediary region 7 of the clothes hanger 1 according to the invention. This hook element 17 is embodied here in the form of an additionally attached collar 17, wherein this collar encompasses the second arm section 6*b* of the first hanger arm 6 and the second arm, which is embodied by means of the actual second hanger arm 11 and by means of its loop-shaped return 15.

FIG. 6B shows a sectional view, wherein the plane of intersection extends along the line B—B shown in FIG. 6A, perpendicular to the plane of the drawing. The projection 18 of the collar 17 can be clearly seen here. Furthermore, in the cross section, the embedded and enclosed hanger arms or arm sections 6*b,* 11, and 15 are shown here with circular cross sections. Furthermore, the movement process in the transition from the open to the closed state of the hanger 1 is also shown here with dashed markings of the first arm section 6*a* that is moved. Initially, the first arm section 6*a* is moved from above downward past the collar 17, and then snaps back upward due to the restoring elastic forces, wherein it comes to engage the projection 18 of the collar 17.

FIG. 7 describes another exemplary embodiment of the hook element 17 for opening and closing the clothes hanger 1 according to the invention. In this case, the hook element 17 is manufactured as a projection 18 out of the material of the second arm section 6*b* of the first hanger arm 6.

Figure 7A:
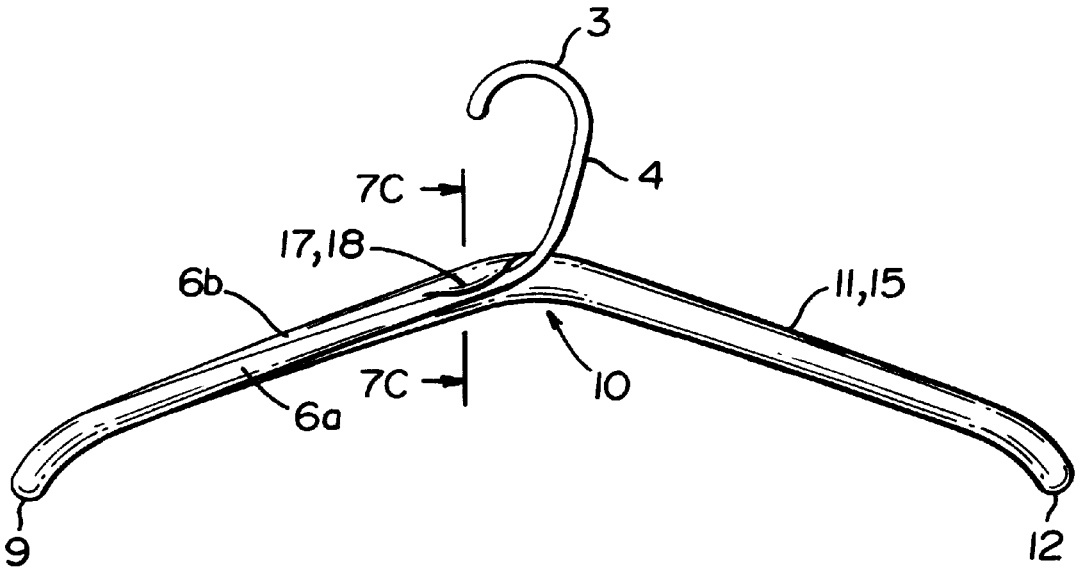
Figure 7B:
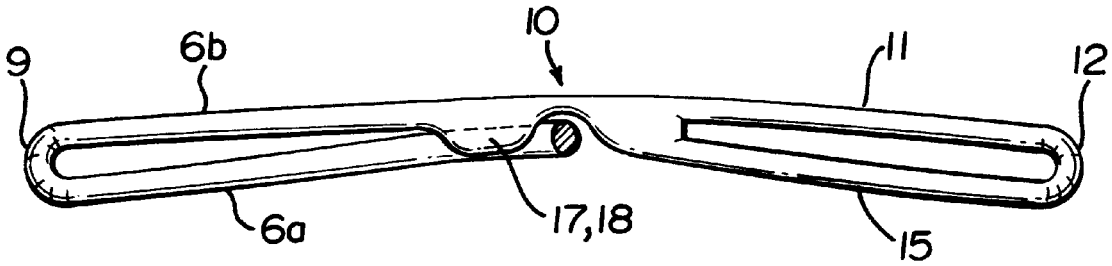
Figure 7C:
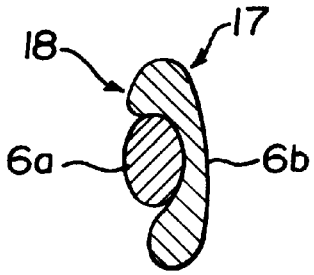

FIG. 7A shows a front view of this embodiment in the closed state, and FIG. 7B shows a view from below for the same exemplary embodiment. The position of an intersecting plane is represented with the line C—C. This intersecting plane extends directly through the hook element embodied on the second arm section 6*b,* which is represented cross sectionally in FIG. 7C, wherein here too, the closed state of the clothes hanger has been shown. As in the embodiment with the collar, here too, after being guided past the hook element 17, the first arm section 6*a* of the first hanger arm 6 comes to rest against the projection 18 of the hook element 17 by means of the restoring elastic forces, by means of which the hanger 1 is closed with regard to its intermediary region 7 and remains so.

The other exemplary embodiment represented in FIG. 8 shows a clothes hanger that preferably can be manufactured out of bent wire. Its shaping is simplified in relation to the hanger shown in FIG. 4 in such a way that the first and second arm sections 6*a,* 6*b* of the first hanger arm are disposed in a plane with an essentially constant spacing in order to form the intermediary region 7. By means of this, the manufacturing process is simplified, wherein with the use of a material with a small cross section, though, the advantage of the exemplary embodiment according to FIG. 4 is lost, namely a relatively wide support area for the shoulder regions of the clothing item. Instead of the second hanger arm ending in an outer loop 20, as depicted in FIG. 8, in order to achieve a weight-centered balance, it can in turn be guided back essentially into the region of the vertical V.

The clothes hanger depicted in FIG. 9 has an intermediary region that has been changed in relation to the embodiment according to FIG. 8; the spacing between the first and second arm sections 6*a,* 6*b* in the region of the bend between the neck region 4 and the first arm section 6*a* is relatively small, preferably only slightly greater than the thickest point of the clothing item to be threaded on. In connection with a relatively slight thickness of the material of the first arm section 6*a* in the region of the opening of the intermediary region, the advantage arises that the bend region 10 can be moved essentially into the plane of the vertical V. In this way, even items of clothing with an extremely narrow neck opening can also be supported in the shoulder regions in the immediate vicinity of the neck opening.

In addition, the cross section of the first and second arm sections 6*a,* 6*b* of the first hanger arm 6 and the cross section of the second hanger arm are chosen so that the top sides, i.e. the support faces are cross sectionally broadened, approximately into a T-shape (cross sections X, Y, Z in FIG. 9*a*). This brings about the advantage of a broader support and with, it a crease-free holding of the clothing item.

FIG. 10 shows a front view of another embodiment of a clothes hanger according to the invention.

This embodiment essentially corresponds to the embodiment according to FIG. 1, but has a suspension region 3 which is embodied as a simple hook made of bent wire. As already explained above, this can be connected in rotary fashion to the arm section 6*a* of the hanger arm 6.

In this embodiment, the arm section 6*a* has a greater height on its end connected to the suspension region 3 and extends until the other side of the vertical V and the central plane established by it (perpendicular to the plane of the drawing) above the second hanger arm 11. This region 6*c* with greater height has contact shoulders 6*d* on both sides of the vertical V that are essentially symmetrical to the vertical V. They serve as contact shoulders for a neck of a clothing item, not shown, and assure that the neck retains its shape even when the item of clothing is hung for a long time.

At the same time, the front and back sides of the region 6*c* can be used as an advertising surface or for other inscriptions.

With a constant thickness of the hanger arms 6, 11, the region 6*c* is preferably produced so that in each particular spacing from the vertical V, the sum of the thicknesses (heights) of the arm sections 6*a*, 6*b* is essentially equal to the sum of the thicknesses (heights) of the region 6*c* on the other side of the central plane, the vertical V, and the second hanger arm 11.

By means of this, a completely horizontal suspension of the hanger can be assured, even when it is not encumbered by an item of clothing.

It should be noted, though, that in the narrower proximity of the vertical V or the central plane of the hanger, a variation from the above-mentioned requirement is possible, if slight. An essentially balanced hanger can also be produced when the requirement "sum of the heights of the arm sections 6*a*, 6*b* is equal to the height of the second hanger arm 11 at the same distance from the central plane" is only fulfilled outside a particular spacing from the central plane.

At this point, it should be noted that the hanger arms or arm sections can naturally also have inconstant thicknesses, for example can have a double T profile in a known manner. In this instance, a balanced hanger is produced when in each plane spaced apart from the central plane of the clothes hanger by a predetermined amount, the cross sectional area of the second hanger arm (11) is chosen so that it essentially corresponds to the sum of the cross sectional areas of the arm sections (6*a*, 6*b*) of the first hanger arm (6).

In the embodiment according to FIG. 10, with a region 6*c* of larger height of the first arm section 6*a*, an optimally balanced hanger is achieved, moreover, when the region 6*c* is produced so that the partial region that is disposed above the second hanger arm (11) on the other side of the central plane, has a cross sectional area in each plane parallel to the central plane, which area in sum with the cross sectional area of the second hanger arm (11) in this plane essentially corresponds to the sum of the cross sectional areas of the first and second arm sections (6*a*, 6*b*) of the first hanger arm in a parallel plane with the same distance to the center plane.

Deviations from this requirement in the narrower region around the center plane, though, (due to the reduced lever action) in a particular quantity, have no relevant influence on the balance of the hanger.

These general embodiments are naturally valid for each of the embodiments represented. Furthermore, arbitrary combinations of individual features of the various embodiments are considered to fall within the scope of the invention.

Finally, it should be emphasized that individual features or all of the features of the above-described exemplary embodiments can naturally be combined into new embodiments.

We claim:

1. A clothes hanger (1), a) with a hanger suspension region (3) and at least first and second hanger arms (6, 11) for holding items of clothing, of which the first hanger arm (6) extends from the hanger suspension region (3), and has first and second arm sections (6*a*, 6*b*), which are spaced apart by means of an intermediary region (7) that is open on one end and is embodied as a narrow gap (7), b) wherein the hanger arms (6, 11) have an essentially constant cross section and c) wherein the first and second hanger arms (6, 11) have top sides (6', 11') which enclose an obtuse angle, at a bend region, of less than 180°, with the vertex toward the suspension region (3), characterized in that d) the second hanger arm (11) has an outer end region (12) which is embodied by means of a parallel return (15) in the form of a loop (19), wherein the return (15) essentially extends from the end region (12) to the center plane of the hanger between the end reaction (12) and an end region (9) of the first (6) hanger arm, and e) the suspension region (3) is disposed in a weight-centered fashion between the first and second hanger arms (6, 11).

2. The clothes hanger according to claim 1, characterized in that the gap (7) of the first hanger arm (6) and the loop-shaped end region (12) of the second hanger arm (11), which is formed with the return (15), are essentially symmetrical to each other with regard to a horizontal intersecting plane.

3. The clothes hanger according to claim 2, characterized in that the arm sections (6*a*, 6*b*) are disposed essentially next to each other at one level, and the first arm section (6*a*) extends from the suspension region (3).

4. The clothes hanger according to one of claim 1, characterized in that the arm sections (6*a*, 6*b*) are disposed horizontally next to each other in the end region (9) and that the arm sections (6*a*, 6*b*) are disposed vertically above each other in a region (5) where the first arm section (6*a*) extends from the suspension region (3).

5. The clothes hanger according to claim 4, characterized in that the transition from the vertical disposition of the arm sections (6*a*, 6*b*) in the region (5) to the horizontal disposition of the arm sections (6*a*, 6*b*) in the end region (9) occurs in a continuous fashion.

6. The clothes hanger according to claim 1, characterized in that the second hanger arm (11) transitions into a third hanger arm (15) at its outer end region (12).

7. The clothes hanger according to claim 6, characterized in that the second arm section (6*b*) and said third hanger arm 15 have top sides, selected ones of the course of the top side of the first hanger arm (6), the course of the top side of the second hanger arm (11), the course of the top side of the second arm section (6*b*) of the first hanger arm (6), and the course of the top side of the third hanger arm (15) being embodied as wavy.

8. The clothes hanger according to claim 7, characterized in that the amplitude of the wavy course steadily decreases in the direction of the vertical (V).

9. The clothes hanger according to claim 1, characterized in that a hook element (17) is mounted to the bend region (10), said hook element (17) selectively hooking the first arm section (6*b*).

10. The clothes hanger according to claim 9, characterized in that the hook element (17) has a projection (18), the first arm section (6*a*) resiliently flexing for engagement with the hook element projection (18) wherein said first arm section (6*a*) is resiliently and releasably retained.

11. A clothes hanger (1), a) with a hanger suspension region (3) having a vertical axis and a corresponding central plane and at least first and second hanger arms (6, 11) for holding items of clothing, said first hanger arm (6), extends from the hanger suspension region (3), and includes first and second arm sections (6*a,* 6*b*), which are spaced apart to define an intermediate slot (7) open on one end and embodied as a narrow gap (7) extending substantially along the entire length of said first and second arm sections but distal from the outermost end of the arm, and b) wherein the first and second hanger arms (6, 11) have upper edges (6', 11') converging to define an obtuse angle, of less than 180°, with the vertex of said angle toward said suspension region (3), and wherein c) first and second cross-sectional planes of the clothes hanger arms are spaced from the vertical axis by equal predetermined distances, the second hanger arm (11) includes a cross-sectional area which essentially corresponds to the sum of cross sectional areas of the arm sections (6*a,* 6*b*) of the first hanger arm (6) and wherein d) the suspension region (3) defines a balanced weight-center between the first and second hanger arms (6, 11).

12. The clothes hanger according to claim 11, wherein the first arm section (6*a*) at said suspension region includes an area of greater height than said arm section extending beyond the central plane in the direction of the second hanger arm (11), wherein said area of greater height includes a contact shoulder on each side of the vertical axis at a predetermined distance from said axis defining contact faces for a collar of a clothing article.

* * * * *